US007686513B2

(12) United States Patent
Knoerzer et al.

(10) Patent No.: US 7,686,513 B2
(45) **Date of Patent: *Mar. 30, 2010**

(54) MULTI-LAYER FLEXIBLE PACKAGE WITH REMOVABLE SECTION

(75) Inventors: Anthony Robert Knoerzer, Parker, TX (US); Garrett William Kohl, Allen, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 1335 days.

This patent is subject to a terminal disclaimer.

(21) Appl. No.: 11/145,399

(22) Filed: Jun. 3, 2005

(65) Prior Publication Data

US 2006/0285780 A1 Dec. 21, 2006

(51) Int. Cl.
*B65D 30/08* (2006.01)

(52) U.S. Cl. ..... 383/111; 206/831

(58) Field of Classification Search ..... 383/111, 383/109, 105, 210, 211; 428/42.4, 42.3; 206/831

See application file for complete search history.

(56) References Cited

U.S. PATENT DOCUMENTS 4,174,597 A 11/1979 Mowli et al.
4,308,679 A 1/1982 Ray, III et al.
4,345,393 A * 8/1982 Price et al. ..... 40/312
4,785,937 A * 11/1988 Tamezawa et al. ..... 206/484
5,044,776 A 9/1991 Schramer et al.
5,127,743 A 7/1992 Miller et al.
5,176,452 A 1/1993 Stern
5,582,889 A 12/1996 Pedrini
5,871,096 A * 2/1999 Yakich ..... 206/459.5
5,914,165 A * 6/1999 Freedman ..... 428/40.1
6,041,929 A * 3/2000 Brunner et al. ..... 206/459.5
6,206,570 B1 * 3/2001 Cortopassi ..... 383/127
6,230,968 B1 * 5/2001 Varadarajan ..... 229/201
6,267,243 B1 * 7/2001 Sumpmann et al. ..... 206/459.5

(Continued)

FOREIGN PATENT DOCUMENTS

EP 0 596 747 5/1994

*Primary Examiner*—Jes F Pascua
(74) *Attorney, Agent, or Firm*—Colin P. Cahoon; Bobby W. Braxton; Carstens & Cahoon, LLP

(57) ABSTRACT

A flexible container with a wall structure comprised of multi-layer, flexible thin films, including a first film layer that is affixed to the wall structure by a releasable adherence and that incorporates a removable piece. The removable piece is incorporated into the first film layer such that, other than at least one continuous cut facilitating removal and any conspicuous printing on the removable portion, it is indistinguishable from the rest of the exterior of the package. The continuous cut allows for full or partial detachment of the removable portion from the first film layer so that only the releasable adherence prevents it from separating from the container. The removable piece is removed by peeling it away from the container, where the initiation of the peeling is facilitated by a smaller peel force adjacent the continuous cut. The removable piece may function as a promotional or collectible piece such as a gaming piece or redeemable coupon, or may be designed to retain a tacky surface and function as a sticker or as a piece of tape to close an opened bag. The removable piece can also expose a tacky surface on the container to permit closure of the opened bag.

74 Claims, 4 Drawing Sheets

U.S. PATENT DOCUMENTS 6,338,864 B1 * 1/2002 Deering et al. ..... 426/106
6,383,592 B1 * 5/2002 Lowry et al. ..... 428/40.1
6,410,111 B1 * 6/2002 Roth et al. ..... 428/40.1
6,457,585 B1 * 10/2002 Huffer et al. ..... 206/459.5
6,475,587 B1 * 11/2002 O'Neill ..... 428/40.1
6,517,243 B2 2/2003 Huffer et al.
6,670,008 B1 * 12/2003 Ognissanti et al. ..... 428/40.1
6,746,743 B2 * 6/2004 Knoerzer et al. ..... 428/42.1
6,991,261 B2 * 1/2006 Dronzek et al. ..... 283/81
7,189,300 B2 * 3/2007 Knoerzer et al. ..... 156/256
2003/0127178 A1 7/2003 Anderson et al.
2003/0223653 A1 12/2003 Knoerzer et al.
2004/0067326 A1 4/2004 Knoerzer et al.
2004/0136614 A1 * 7/2004 Seidler ..... 383/4
2005/0025941 A1 * 2/2005 Nowak ..... 428/195.1
2005/0079322 A1 4/2005 Knoerzer et al.
2006/0019049 A1 * 1/2006 Vaughn ..... 428/40.1
2006/0198986 A1 * 9/2006 Keckeisen et al. ..... 428/136

* cited by examiner

FIG. 3
(PRIOR ART)
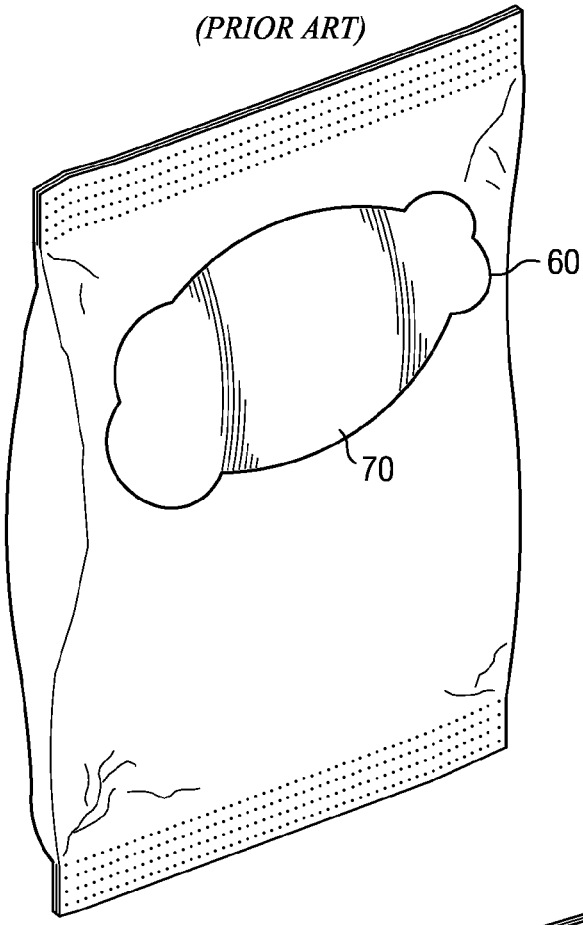
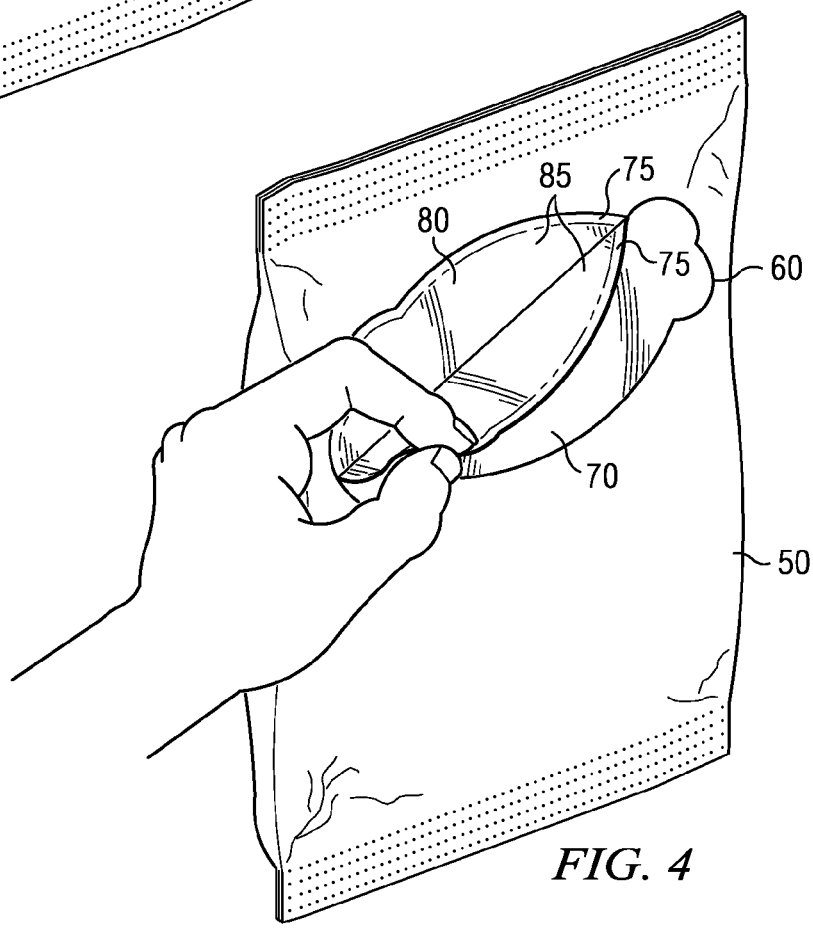
FIG. 4

FIG. 5A
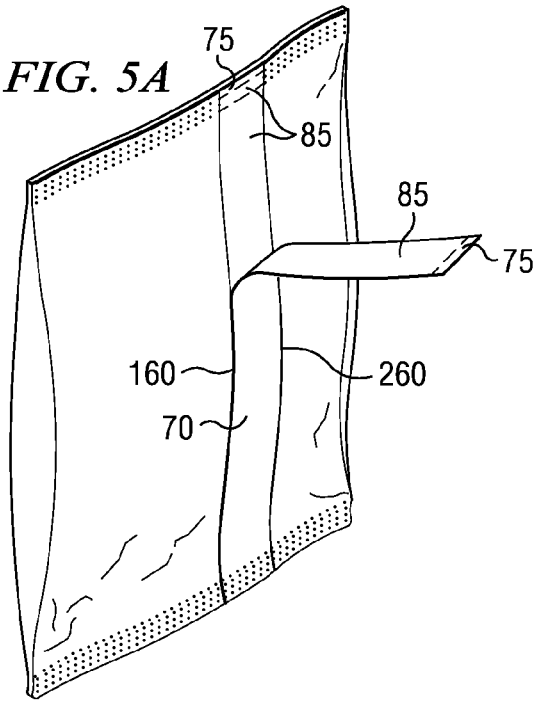
FIG. 5B
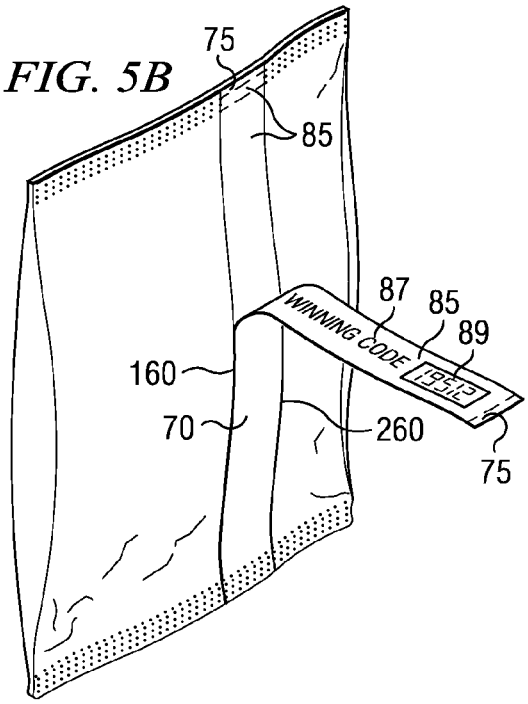
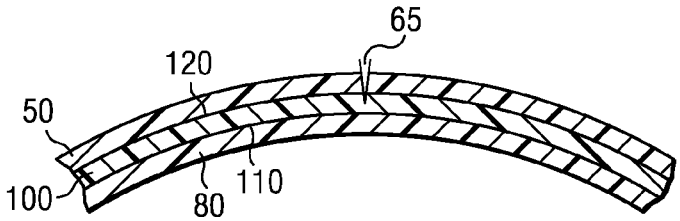
FIG. 6
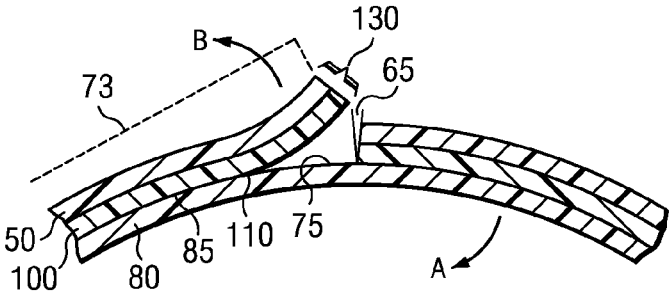
FIG. 7
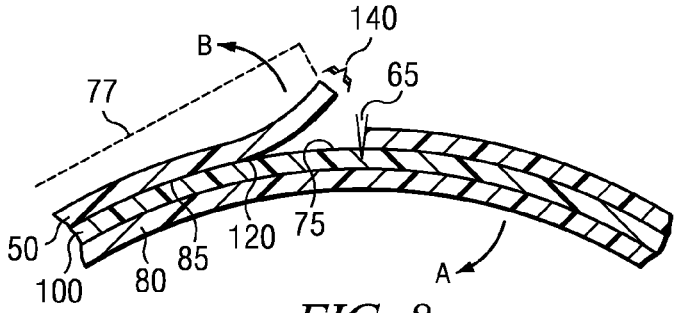
FIG. 8

MULTI-LAYER FLEXIBLE PACKAGE WITH REMOVABLE SECTION

BACKGROUND OF THE INVENTION

1. Technical Field

The present invention relates to a flexible bag or package with walls made up of multi-layer thin films wherein a section of at least one layer of said multi-layer film can easily be removed without compromising the barrier properties of said bag. In particular, the removable section is adhered to the package at an initiation area having a lower peel force to more easily facilitate initial removal and a remaining area having a higher peel force.

2. Description of Related Art

Flexible bags are commonly used for packaging. For food packaging, in particular, flexible bags with walls made up of multi-layer flexible films and specific barrier properties are common for containing foods such as chips, popcorn, nuts, or cereals. It is also common for promotional devices to accompany all types of packaging, including paperboard, cardboard, and polymer and other flexible thin film packaging. Such devices may be incorporated into packaging any number of ways.

U.S. Pat. Nos. 6,251,450 ('450) and 5,127,743 ('743) disclose food packages with walls comprised of multi-layer of flexible films wherein a promotional device is sealed between layers of the multi-layered package wall.

The '743 patent discloses a method of forming a package comprised of multi-layer flexible films wherein a promotional device is printed on the inside surface of one of the outer layers of the package. The promotional printed indicium is only partially visible from the outside of the package and is accessed by puncturing the outer layer of the package and separating the inner layer from the outer layer containing the hidden indicia. This separation is possible because no adhesive is applied between the portion of the outer layer containing the printed hidden indicia and the next innermost layer of the container.

As illustrated by the '450 and '743 patents, when promotional devices have been incorporated into flexible plastic bags composed of thin films in the prior art, the devices are not conveniently accessible to the consumer. The devices are generally either placed inside the bag along with the product, or embedded between the layers of the bag and sealed in place by an adhesive such that the bag must be cut, torn, or punctured in some way in order to gain access to the device. FIG. 1 is one example of this type of design and is a view of a cross-section of the wall of a package that incorporates a promotional device. The wall includes an outer layer 18 and an inner layer 20. Hidden printed indicia 24 are incorporated into the conventional printed layer 22, and both are printed on the inner facing side of the outer layer 18. The hidden printed indicia portion 24 consists of a series of printed ink layers 26, 28, 30, which includes a layer containing the promotional device 30, and printed layers 26, 28 that reveal the existence of the promotional device but obscure its exact nature when viewing from outside the package. The outer layer 18 is attached to the inner layer 20 by an adhesive layer 32. The adhesive layer 32, however, is not applied in the area where the hidden printed indicia portion 24 contacts the inner layer 20. When the outer layer 18 is cut or punctured to access the promotional device 24, this permits the portion of the outer layer 18 containing the device 24 to be separated from the inner layer 20 and viewed directly.

One problem with designs such as the '743 and '450 patents is that the cutting or tearing necessary to access the promotional device sacrifices the container's functional characteristics. The necessity of additional manufacturing steps is also a drawback of designs that place the promotional piece either inside the package or between the walls of the package. The additional steps greatly increase operating, material, and defect costs. Furthermore, if a promotional prize is inadvertently left out of a container, such process errors are likely to go undetected and have often ultimately lead to customer complaints.

U.S. Pat. No. 4,345,393 ('393) is one of many examples in the prior art where promotional devices are incorporated into packaging. The '393 patent discloses a two-ply, erect, paperboard or cardboard carton. In a defined section of the outer ply of the carton, slits/perforations are cut to outline a desired size and shape such that the defined section may be torn along the slits/perforations and removed from the carton without disturbing the integrity of the rigid inner ply.

Another example of an invention where a promotional device is incorporated into packaging is U.S. Pat. No. 5,021,274 ('274). The '274 patent discloses a two-ply, erect, paperboard or cardboard container, including a corrugated inner ply and an outer ply incorporating a removable section outlined by a perforated die cut. The perforated die cut allows the removable section to be torn away from the package while leaving the corrugated inner ply intact.

As demonstrated by the '393 and '274 patents, promotional devices have also been incorporated into the walls of containers other than flexible bags, such as erect paperboard cartons or boxes. In some of these designs, the promotional device may be accessed without compromising the functional characteristics of the container. In others, however, removal of the device results in a hole in the container. FIG. 2 is an example of a container design wherein a promotional device is incorporated into the outer ply of a two-ply erect carton constructed from paperboard or cardboard. The integrity of the carton is not compromised upon accessing the device. In this embodiment, the outer ply 52 of the box is bonded to the inner ply by an adhesive layer 60. The promotional device is in the form of a detachable coupon 63 that is a portion of the outer ply 52. The coupon 63 is outlined by perforated slits 64 in the outer ply 52 that permit the coupon 63 to be removed by tearing along said perforated line 64. The coupon 63 portion of the outer ply 52 does not adhere to the inner ply because the inner side 66 of the outer ply 52 corresponding to the coupon 63 is coated with an adhesive-repelling agent. Employment of the adhesive-repelling agent and perforated tear outline 64 in combination permit the coupon 63 to be torn from the container.

One drawback of a design similar to the one illustrated by FIG. 2 is that perforated lines do not always tear cleanly, and as they are torn are prone to snagging and causing undesired tearing outside the perforated lines. Such unwanted tearing of the package or promotional device outside the perforated line may reduce the aesthetic value of any designs on the package or promotional device. In addition, depending on the type of promotional device, such unwanted tearing of the device may reduce its redeemable value and/or its value to a consumer.

The designs of the '393 and '274 patents also require that the container be in the form of an erect carton assembled from paperboard or cardboard materials. They do not contemplate important improvements in packaging material technologies, such as use of polymeric, multi-layered, flexible thin films. These newer materials are stronger and more flexible per unit of material than paper, paperboard, or cardboard-type packaging materials pertinent to the '393, '274 designs. Additionally, thin-film packaging materials, such as employed in packaging some snack foods, are orders of magnitude thinner and less bulky than their cellulose product counterparts. In many applications, these differences and improvements in dimensional and functional characteristics of packaging materials render the older wood-based materials useless. In addition, the drastic differences in physical characteristics between flexible thin films and wood-based packaging materials present drastically different processing problems, and require significant development to optimize effective thin film packaging.

One solution to address these problems is disclosed in U.S. Pat. No. 6,746,743, assigned to the same assignee as the present invention, and is hereby incorporated by reference. FIG. 3 is a perspective view of an embodiment of this prior art reference wherein a removable promotional piece is designed into the outer layer of a container and is outlined by a continuous cut 60. The '743 patent discloses a multi-layer flexible thin film container having a constant degree of releaseable adherence across the surface of the container. A continuous cut 60 penetrates the outer ply to permit the portion of the outer ply 70 bounded by the continuous cut 60 to be removed from the container. The releasable adherence provides a peel force to sufficiently adhere the outer ply 70 to the container such that the outer ply 70 is not removed during normal shipping and handling operations. To initiate removal, the peel force provided by the releasable adherence must be overcome. One drawback of this invention is the potential difficulty in overcoming the peel force to initiate removal of the outer ply 70. Further, it may be desirable to strengthen the peel force to prevent inadvertent removal of the outer ply 70 while still permitting easy initiation.

Consequently, there is a need for an improved container with enhanced barrier characteristics due to its construction from polymeric multi-layer flexible films. The container should provide an easier way to initiate removal of the removable piece. The container should also permit a stronger releasable adherence to be applied to selected portions of the package. The removal of the device from the package should not result in damage to the device itself or the package. Furthermore, removal of the device should not compromise the advanced barrier characteristics of the package.

SUMMARY OF THE INVENTION

The proposed invention comprises a flexible container formed from multi-layer thin films that incorporates a removable piece, defined by at least one continuous cut, into the outermost layer of the container. The degree of adherence of the outermost to the next outermost layer of the package is varied such that a lesser adherence exists at an initiation area, adjacent to the continuous cut, to facilitate removal of the outer ply. Additionally, removal of the piece does not compromise the functional characteristics, such as barrier properties, of the container.

The design is such that, upon removal, the piece may or may not retain a tacky surface and may take on any number of forms such as that of a redeemable coupon, gaming piece, trading card, sticker, tape, partially or fully illustrative decorative or promotional item, etc. Further, in one embodiment of the invention, the container retains minimum required barrier properties after removal of a portion of the outer ply. The above as well as additional features and advantages will become apparent in the following written detailed description.

BRIEF DESCRIPTION OF THE DRAWINGS

The novel features believed characteristic of the invention are set forth in the appended claims. The invention itself, however, as well as the preferred mode of use, and further objectives and advantages thereof, will be best understood when described in conjunction with the following illustrative embodiments wherein:

FIG. 3 is a perspective view of an embodiment of the prior art wherein a removable piece is designed into the outer layer of a container and is outlined by a continuous cut;

FIG. 4 is a perspective view of an embodiment of the present invention illustrating an initiation area and a remaining area;

FIG. 5*a* is a perspective view of an alternative embodiment of the present invention illustrating an initiation area and a remaining area.

FIG. 5*b* is a perspective view of one embodiment of the present invention illustrating a redeemable coupon.

FIG. 6 is a cross-sectional view of one embodiment of the present invention wherein the cut is illustrated penetrating through the container's outermost layer and terminating at a depth within the adhesive layer;

FIG. 7 is a cross-sectional view of one embodiment of the present invention in the area of the cut wherein separation of the layers by peeling at the cut occurs between the adhesive layer and second outermost layer;

FIG. 8 is a cross-sectional view of one embodiment of the present invention in the area of the cut wherein separation of the layer by peeling at the cut occurs between the outermost layer and adhesive layer;

DETAILED DESCRIPTION

Figure 1:
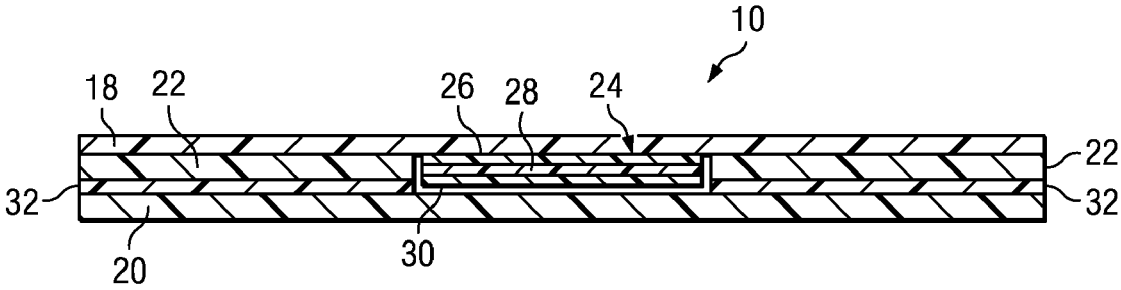
FIG. 1 (PRIOR ART)
FIG. 1 is an illustration of a cross-section of a multi-layer container of the prior art wherein a promotional piece is incorporated between the layers of the wall of the container.
Figure 2:
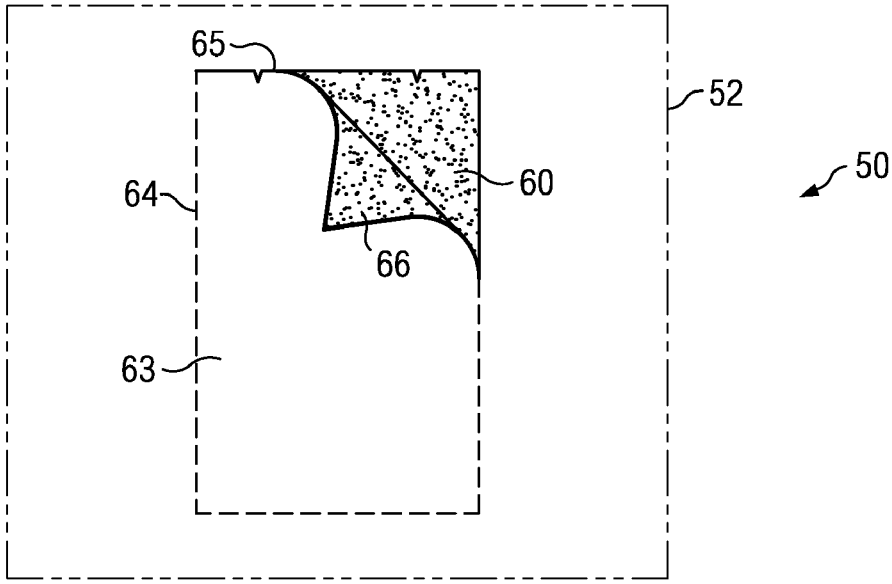
FIG. 2 (PRIOR ART)
FIG. 2 is an illustration of a container of the prior art wherein a portion of the outer layer of the container is designated as a removable coupon and defined by a perforated tear outline.

FIG. 4 illustrates a container in accordance with an embodiment of the present invention. The container wall structure includes at least two film layers. In one embodiment, a continuous cut 60 in the first film 50 of the container defines a removable portion or piece 70 of said first film 50. As used herein removable portion, removable piece, banner, and removable section are synonymous are refer to a removable portion defined by at least one continuous cut 60.

FIG. 5*a* illustrates a container in accordance with an alternative embodiment of the present invention. As exemplified by one embodiment, the removable portion 70 is defined by a first continuous cut 160 and a second continuous cut 260. In an alternative embodiment, the lap seal can function as either the first continuous cut 160 or second continuous cut 260 to define the size and shape of the removable portion 70 so that only a single longitudinal continuous cut is required, reducing the required number of score lanes.

Referring back to FIG. 4, the continuous cut 60 defines the size and shape of the removable portion 70 and is of a depth greater than the thickness of the first film layer 50, but such that removal of the portion 70 does not compromise the barrier and other functional characteristics of the container.

Prior to executing the continuous cut 60, the first film layer 50 of the container is adhered to the second film layer 80 of the container by a releasable adherence. The continuous cut 60 is continuous such that if the first film layer 50 were not adhered to the second film layer 80 of the container, said removable portion 70 would not remain affixed to the container. In one embodiment, the releasable adherence allows the first film layer 50 to be easily peeled away from the second film layer 80 at any cross-section of the bag's wall. Thus, the releasable adherence affixes the container's first film layer 50, including the removable portion 70, to the second film layer 80.

A novel feature of the present invention is the variability of peel force provided by the releasable adherence that more easily permits initial removal of the removable portion 70. By provision of a lower, first peel force at an initiation area 75, a consumer is better able to initiate the removal of the removable portion 70. For example, once removal has begun and part of the removable portion 70 can be gripped by a pair of fingers, it becomes easier to overcome higher peel forces. Thus, a higher, second peel force applied to the remaining area 85 of the removable portion 70 can help ensure the removable portion 70 is adhered to the package during shipping and handling and is not removed until purposely done so by a consumer.

In one embodiment, the first peel force is between about 5 and about 35 grams and more preferably about 10 grams. In one embodiment, the second peel force is between about 25 and about 75 grams and more preferably about 50 grams. In one embodiment, the second peel force is between about 1.5 to about 10 times and more preferably about 5 times the first peel force. It should be noted that peel force can be easily controlled above and below these ranges and these embodiments are given for illustration and not limitation.

The differing peel forces can be provided in a number of ways. In one embodiment, a releasable agent having a lesser, first peel force can be used at an initiation area 75 and a releasable agent having a greater, second peel force can be used in the remaining area 85. In an alternative embodiment, a different application density of a release agent can be applied per unit area to the initiation area 75 (e.g., more or less dense application of release agent) than is applied to remaining area 85. This can be achieved by, for example, differing the pattern of the application. For example, the pattern of releasable agent can be solid in the initiation area 75 and dotted in the remaining area 85, or vice versa, depending on the peel force associated with the releasable agent used. This embodiment may be desirable to maximize the number of colors on a package as the application of each different releasable agent can correspondingly lower the number of colors available for application to the flexible film. As the density of release agent decreases, the peel force decreases. Conversely as the density of release agent increases, the peel force increases.

In one embodiment, the remaining area 85 comprises a third peel force. The third peel force can be higher or lower than the second peel force. It may be desirable, for example, to have a higher third peel force to provide a tacky surface upon removal.

In yet another embodiment, a first releasable agent having the same peel force can be initially and uniformly applied to both the initiation area 75 and the remaining area 85, and then a second releasable agent having a lesser peel force can be applied by an intermittent pattern (e.g. small dots) to the entire initiation area 75 to lower the average peel strength of the initiation area 75. Those skilled in the art will recognize that the above embodiments can be combined of achieving differing peel forces as desired. For example, a first releasable agent having a lesser first peel strength can have a smaller application of release agent at an initiation area 75 than a second releasable agent having a greater application of a greater second peel strength release agent applied to the remaining area 85. The objective is to provide for lesser peel strength at an initiation area 75 than is supplied in the remaining area 85. Those skilled in the art understand that the above can be achieved with the use of anilox rollers in a flexographic operation.

The cutting tool that executes the continuous cut 60 leaves an unbroken line where the edge of the removable section 70 meets the edge of the surrounding, first film layer 50 of the container. The removable section 70 forming a removable piece can be separated from the container by application of some pressure from moving a finger over the area of the continuous cut 60 or by placing a fingernail into the cut and applying pressure to reveal an edge. The edge of the removable section 70 lifts away from the container such that a consumer can then seize the edge and easily peel the remaining area 85 of the removable portion 70 completely away from the container.

The initiation area 75 can be placed anywhere adjacent a cut. For example as shown in FIG. 4, the initiation area 75 can be located about the entire outside perimeter of the removable portion 70. Such an embodiment permits a consumer to easily initiate peeling at any location adjacent the cut 60. Preferably, the initiation area 75 extends from the cut inward at least about 5 millimeters and more preferably between about 5 and about 10 millimeters. In one embodiment, the initiation area 75 can be located as shown in FIG. 5, about a portion of the perimeter of the removable portion. Printing indicia on the package can be used to flag this location to the consumer.

The material that forms the first film layer 50 of the bag typically also serves as the product label and may contain printed information and/or decorative designs that identify the product and provide nutritional and other information about the product. The removable section 70 of the present invention is also incorporated into the first bag layer 50 and, therefore, the printing, pictures, and/or designs identifying and explaining the promotional piece are included among the printing, pictures, and/or designs that decorate the bag and identify the product enclosed. In this way, the printing on the removable portion 70 of the first film layer 50 of the bag may, in addition to the continuous cut 60, further identify the existence and location of the promotional piece because it interrupts, and is eye-catching amid, the rest of the printing on the bag. Other than the continuous cut 60 defining the removable section 70 and any conspicuous print on said removable section 70, the promotional piece can be indistinguishable from the rest of the first film layer 50 of the container.

Figure 9A:
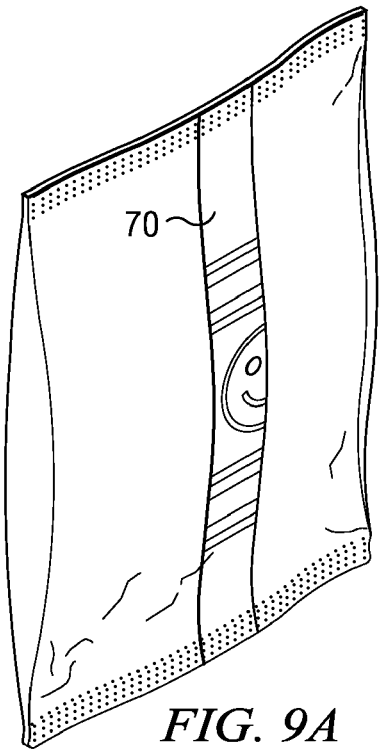
FIG. 9*a* is a perspective view of an embodiment of the present invention illustrating a promotional piece.
Figure 9B:
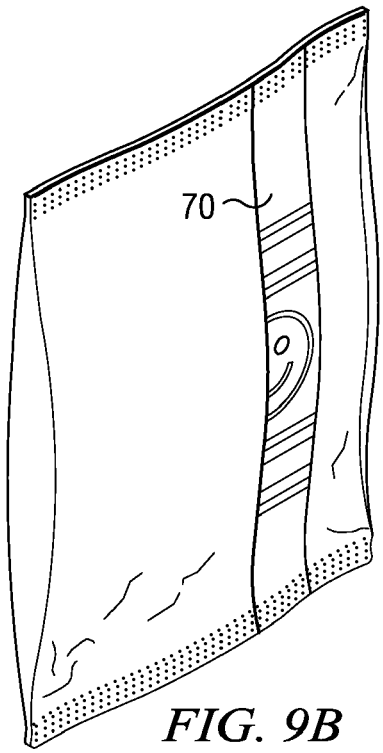
FIG. 9*b* is a perspective view of an embodiment of the present invention illustrating a promotional piece.
Figure 9C:
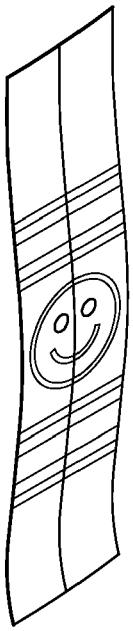
FIG. 9*c* is a perspective view of two promotional pieces forming a larger illustration.

In one embodiment, a promotional piece 70 may take on a number of forms. For example, the promotional piece can be a collectible piece including, but not limited to a sticker, a trading card, redeemable coupon, or any sort of game piece. In addition, the theme and character of the promotional piece may be printed on the outside or inside of the removable portion, on the package underneath the removable portion, or any combination of the three. In one embodiment, the promotional piece 70 comprises a portion of a larger gaming piece or larger illustration. For example, an illustration of a particular show (e.g. movie or television scene) or character requiring three promotional pieces can be made. The first promotional piece can then be sold at a first window of time, the second promotional piece can be sold during a second window of time and a third piece can be sold at a third window of time. Alternatively, all three pieces can be available for sale on different packages at the same time. Such example is provided for illustration and not limitation. FIG. 9*a* is a perspective view of an embodiment of the present invention illustrating a promotional piece. FIG. 9*b* is a perspective view of an embodiment of the present invention illustrating a promotional piece. FIG. 9*c* is a perspective view of two promotional pieces forming a larger illustration. As can be seen, the two promotional pieces 70 from FIG. 9*a* and FIG. 9*b* combine for form a larger illustration in FIG. 9*c*.

Figure 10:
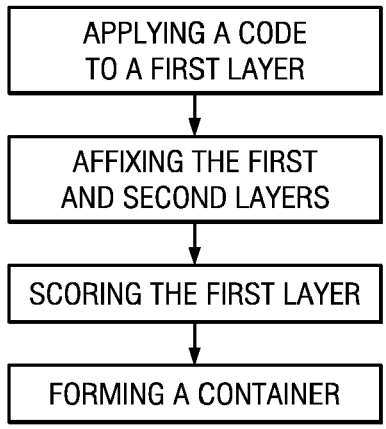
FIG. 10 is a flow chart of one embodiment of the present invention illustrating a method for incorporating a removable piece comprising a code.

FIG. 10 is a flow chaff of one embodiment of the present invention illustrating a method for incorporating a removable piece comprising a code. FIG. 10 illustrates one embodiment wherein a code is first applied to the first film layer. Next, the first and second layers are affixed. Then, the first layer is scored. Finally, the container is formed.

FIG. 5*b* is a perspective view of one embodiment of the present invention illustrating a redeemable coupon. In this embodiment, a repeatable message 87 is printed on the package-facing portion of the redeemable coupon 70. The repeatable message 87 is a message that is placed each redeemable coupon. The repeatable message 87 can have several applications including, but not limited to, rules to a game or promotion, instructions to visit a website, etc. In one embodiment, the repeatable message 87 is applied by flexographic printing.

A unique message 89 can also be printed on the package-facing portion of the redeemable coupon 70. In one embodiment, the unique message 89 is applied by an ink jet printer. The unique message 89 can be different on every package sold, or there can be a pre-determined number or percentage of the same unique messages placed on a given number of packages. For example, it may be desirable for 10% of the unique messages to be a coupon for a free product, 40% of the unique message to be for a first discount on a particular product, and 50% to be for a second discount on a particular product.

In one embodiment, the unique message is a code that can be input at a website and can be redeemable for cash, prizes, or discounts on various products or services. In one embodiment, the package having a redeemable coupon contains snack food and the unique message on the redeemable coupon can be used to download a certain number of songs for free or for a reduced price from a website, depending on the code.

Although both a repeatable message 87 and unique message 89 are both shown in FIG. 5*b*, these are just two examples of ways that graphics can be applied to the package facing portion of the redeemable coupon.

In one embodiment, after the repeatable message has been applied by flexographic printing, the film is brought to an unwind and rewind station fitted with multiple inkjet printers for application of the unique message. Alternately, the inkjet printers could be mounted on the film laminator equipment. The ink jet printers can be controlled by a central computer which feeds the ink jet printers the unique message or code. The unique message can be placed by on the packages by equipment available from vendors such as Curwood of Oshkosh, Wis.

In a preferred embodiment, the container of the present invention is a flexible food bag with walls formed from webs of multi-layer flexible thin films. The flexible thin films are of the type commonly employed in the art to produce flexible bags using a typical vertical form, fill, and seal packaging machine, and are typically constructed of thin film layers of up to about 150 gauge thickness (1.5 mils or 0.0015 inches). The desired product environment to be maintained within a package drives the types and arrangements of thin films that are chosen for a particular packaging application. Other considerations include desired shelf life, and cost. A plurality of package designs are possible, depending on the preceding factors. The materials making up the film layers, primarily plastics, are well known in the art. Examples of such materials are various vinyl, metalized, and polymer extrusion films, and various adhesives, ties, and bonding agents for fixing the thin film layers together. These materials vary in cost, as well as in their physical characteristics, such as flexibility, strength, and permeability to substances that decrease the shelf life of a food product, such as oxygen, moisture, and light.

Prior to forming a bag, a releasable adherence can be applied by anilox rollers or other means to a film layer. As previously indicated, the amount and type of releasable agent can be varied to obtain the desired peel force. The film layers that make up the flexible thin films are next laminated together in the desired arrangement. The cutting or scoring, such as with a die or laser cutting tool, that defines the removable portion in what will be the outer layer of the bag also occurs prior to formation of the bag. One way that the cutting can be achieved is disclosed in European Patent Application Publication Number 0 596 747 A1. The scoring may occur during the lamination step as a part of the conversion operation, or as an entirely separate step between lamination and bag formation. Therefore, once the flexible thin films that form the container of the present invention reach the bag formation step, bag formation is the only remaining operation. That is, the flexible thin film layers and thin films are already bonded together in the desired arrangement with any incorporated decorations, such as ink printing or removable promotional pieces, already in place.

FIG. 6 is a cross-sectional view of one embodiment of a wall of a food container in accordance with the present invention. Among the films that make up the wall of the bag is a first polymer film layer 50 adhered to the second film layer 80 of the bag such that the adherence is releasable. In one preferred embodiment, the first film layer 50 is comprised of a polypropylene, polyethylene, or derivative thereof, and the second film layer 80 is comprised of a polymer or metallized polymer of the same type as the first film layer 50. The first film layer 50 and second film layer 80 are separated by an adhesive layer 100 that bonds them together. For illustrative purposes, the cut 65 in the cross-sectional view of FIG. 6 corresponds to the continuous cut 60 160 260 of FIGS. 4 and 5 that defines the size and shape of the removable section 70.

One key consideration of the present invention is maintenance of the container's barrier characteristics. A flexible thin film container's design may vary depending on the type of food being preserved. For instance, the type of food involved determines the desired moisture and oxygen levels inside the container, which along with desired shelf life determines the types and arrangement of flexible thin films employed. Just as the bag design, which is the type and arrangement of films, may be adjusted to account for different foods, it may also be adjusted to account for the removal of a section of the first film layer 50, which contributes to the container's barrier characteristics. First, the continuous cut 65 is controlled so that its penetration is only through the first film layer 50 and terminates at a depth within the thickness of the adhesive layer 100. This controlled penetration of the cutting tool, such as a die or laser cutting tool, prior to detachment of the removable portion 73, does not significantly alter the container's barrier properties. This is because the second film layer 80, and any other layers on the product side of the container wall, are not affected by the cut 65. Also, prior to detachment of the removable portion 73, the continuous cut 65 does not drastically reduce the coverage of the removable portion 73 or the adhesive layer 100 in the area of the cut 65. Second, the number, types, arrangement, and thickness of film layers beneath the first film layer 50, including the thickness of the moisture-blocking adhesive layer 100, may be adjusted to account for any reduction in barrier capacity resulting from detachment of the promotional piece. Considering that multiple pieces may be incorporated into one package, and the plurality of possible shapes and sizes of pieces, this second factor is especially important in the case where the surface area of the piece is a significant percentage of the total surface area of the package's first film layer 50.

In another preferred embodiment, illustrated by FIG. 7, the removable piece takes the form of a sticker. The first film layer 50, comprised of either polypropylene (PP) or polyethylene terephthalate (PET), is bonded to the second film layer 80, also a form of either PP or PET, or metallized PP or PET, by an adhesive layer 100, which in this embodiment is a pressure sensitive adhesive (PSA). A release agent is applied at the interface 110 between the adhesive layer 100 and second film layer 80. The releasable adherence occurs at the interface 110 where the release agent is applied. The adherence is releasable in that the action of the release agent prevents the adhesive 100 from permanently locking the first film layer 50 to the second film layer 80. The interface 110 comprises a portion 73 having an initiation area 75 and a remaining area 85. The strength of the adherence can be measured by the peel force at the interface 110. The initiation area 75 comprises a releasable adherence having a first peel force. The remaining area 85 of the removable section comprising a releasable adherence having a second peel force. The first peel force is less than the second peel force. The releasable adherence having a first peel force at the initiation area 75 permits a small application of force by, for example, a finger or fingernail, in the appropriate direction in the area of the cut 65 to cause an edge 130 of the removable portion 73 to release and lift away from the container. Once the peeling of the removable portion 73 has been initiated, a consumer, now in a position of having a better grip, can then peel the removable portion 73 away from the remaining portion 85 having a greater resistance by seizing the exposed edge 130 and pulling in the direction B. As a consumer peels away the removable portion 73 at the cut 65 in order to access the promotional piece, the action of the release agent at the interface 110 also permits at least a portion of the adhesive layer 100 to peel away from the container and remain adhered to the removable portion 73. In this way, after the removable portion 73 is peeled away, the portion of the adhesive layer 100 that remains affixed to the removable portion 73 retains its tacky quality and allows the removable portion 73 to function as a sticker. Further because the instant invention permits use of a much stronger adhering release agent in the remaining area 85 than was possible in the prior art, a "stickier" sticker can be produced.

In yet another preferred embodiment, illustrated by FIG. 8, the first PP or PET film layer 50, is again bonded to the second PP, PET, or metallized OPP or PET film layer 80 by an adhesive layer 100. However, in contrast to the embodiment illustrated by FIG. 7, in FIG. 8 the release agent resulting in a releasable adherence is applied to the interface 120 between the first film layer 50 and adhesive layer 100. The releasable adherence at the interface 120 prevents the first film layer 50 from permanently locking to the adhesive 100. Consequently, in this embodiment, when the removable portion 77 is peeled away from the container, the adhesive layer 100 remains locked to the second film layer 80, and the releasable adherence allows the removable portion 77 to be separated from the adhesive layer 100 without retaining a tacky surface. As used herein, a tacky surface is defined as a surface that is sticky to the touch. Again, releasable adherence having a first peel force at the initiation area 75, causes, upon small application of force in the area of the cut 65, an edge 140 of the removable portion 77 to release and lift away from the container. A consumer may then peel the removable portion 77, i.e., the promotional piece, away from the container by seizing the exposed edge 140 and pulling in the direction B. Once the removable portion 77 is peeled away, the adhesive layer 100 and release interface 120 remain exposed.

As discussed above, the adhesive layer 100 can provide a tacky or sticky surface on the removable portion 73 as exemplified by FIG. 7. Referring back to FIG. 5, when a tacky surface remains on the outer ply 70, the outer ply 70 can then function as a piece of tape, can be fully or partially removed, and used to close an opened bag to help preserve freshness or prevent spillage of unused product.

In one embodiment, the adhesive layer 100 can provide a tacky surface on the container and function as a piece of tape integral with the container after removal of all or a portion of the removable portion 77 as exemplified by FIG. 8. Thus, the top of the package having no product can be rolled or folded over upon itself to close an opened bag to help preserve freshness or prevent spillage of unused product. Although only a single removable vertical strip is depicted in FIG. 5, other embodiments can be used. For example, two or more vertical or horizontal removable strips can be used.

Among the advantages of the present invention, eliminating the need for any tearing along the edges of the removable section as said section is separated from the container, and any tearing or puncturing of the container at all, reduces the risk of damaging the promotional piece and/or container. In addition, building the promotional piece into the outer layer of the container lowers material and processing costs compared with designs employing a promotional piece that is inside the container or between container walls. Also, by designing the container so that the releasable adherence comprises a smaller peel force at the initiation area permits a consumer to more easily remove the promotional piece, without the frustration reminiscent of one attempting to separate an edge of scotch tape bound to a roll. Further, an adhesive having a third peel force, greater than the second peel force, can be placed in a non-removable portion outside the general area defined as the removable portion 73 (e.g. in the portion of the container not having a removable portion) to help prevent delamination in that area. In one embodiment, the third peel force is greater than 75 grams.

While the invention has been particularly shown and described with reference to a preferred embodiment, it will be understood by those skilled in the art that various changes in form and detail may be made therein without departing from the spirit and scope of the invention.

What is claimed is:

1. A flexible container and incorporated promotional piece comprising:

a container wall structure having at least two thin film layers, wherein a first thin film layer is affixed to a second thin film layer by a releasable adherence having a first peel force at an initiation area less than a second peel force at a remaining area, and wherein said first thin film layer is releasable at any cross-section of the wall structure; and at least one removable portion of said first thin film layer wherein said removable portion possesses a size and shape defined by at least one continuous cut, wherein said initiation area adjacent said continuous cut facilitates removal of said removable portion, and wherein removal of said removable portion does not compromise the barrier properties of the container, and wherein said first peel force results from a different application density of a releasable adherence to said initiation area than is applied to said remaining area.

2. The container of claim 1 wherein said initiation area is located about a perimeter of said removable portion.

3. The container of claim 2 wherein said initiation area extends at least about 5 millimeters from said perimeter.

4. The container of claim 1 wherein said initiation area is located about a portion of a perimeter of said removable portion.

5. The container of claim 4 wherein said initiation area extends at least about 5 millimeters from said perimeter.

6. The container of claim 1 wherein said remaining area further comprises a third peel force that is different from said second peel force.

7. The container of claim 1 having a non-removable portion having a third peel force, wherein said third peel force is greater than said first peel force.

8. The container of claim 1 wherein said removable portion comprises a tacky surface.

9. The container of claim 1 wherein said container comprises a tacky surface upon removal of said removable portion.

10. The container of claim 1 wherein said removable portion comprises a collectible piece.

11. The container of claim 1 wherein said removable portion comprises a portion of a larger illustration.

12. The container of claim 1 wherein said removable portion comprises a unique message.

13. A container having oxygen and moisture vapor barrier properties constructed of multi-layer flexible thin films and an easily removable incorporated promotional piece comprising:

a container wall structure comprising a first film layer and a second film layer, said second film layer affixed to said first film layer by a releasable adherence wherein a removable portion area between said first film layer and said second film layer comprises an initiation area having a first peel force and a remaining area having a second peel force, said second peel force being greater than said first peel force and, wherein said first thin film layer comprises at least one continuous cut, and wherein said first thin film layer is releasable at any cross-section of the container wall; and wherein said first film comprises at least one removable portion comprising said promotional piece, wherein said removable portion possesses a size and shape defined by the continuous cut, wherein at least a portion of said continuous cut is adjacent said initiation area and said first peel force facilitates initial removal of said removable portion, and wherein removal of said removable portion does not compromise the barrier properties of the container, and wherein said first peel force results from a smaller application of a releasable adherence to said initiation area than is applied to said remaining area.

14. The container of claim 13 wherein said initiation area is located about a perimeter of said removable portion.

15. The container of claim 14 wherein said initiation area extends at least 5 millimeters from said perimeter.

16. The container of claim 13 wherein said initiation area is located about a portion of a perimeter of said removable portion.

17. The container of claim 16 wherein said initiation area extends at least 5 millimeters from said perimeter.

18. The container of claim 13 wherein said remaining area further comprises a third peel force that is different from said second peel force.

19. The container of claim 13 having a non-removable portion having a third peel force, wherein said third peel force is greater than said first peel force.

20. The container of claim 13 wherein said removable portion comprises a tacky surface.

21. The container of claim 13 wherein said container comprises a tacky surface upon removal of said removable portion.

22. The container of claim 13 wherein said removable portion comprises a collectible piece.

23. The container of claim 13 wherein said removable portion comprises a portion of a larger illustration.

24. The container of claim 13 wherein said removable portion comprises a unique code.

25. A method of incorporating a removable piece into a container constructed from multi-layer flexible thin films comprising the steps of:

a) affixing a first film layer to a second film layer by a releasable adherence having a first peel force at an initiation area and a second peel force at a remaining area, wherein said first thin film layer is releasable at any cross-section;

b) scoring, thereby defining, a removable portion of said first film layer; and c) forming a container with a wall structure having at least said first film layer and said second film layer, and d) wherein said first peel force results from less releasable adherence at said initiation area than is at said remaining area.

26. The method of claim 25 wherein said initiation area is located about a perimeter of said removable portion.

27. The method of claim 26 wherein said initiation area extends at least 5 millimeters from said perimeter.

28. The method of claim 25 wherein said initiation area is located about a portion of a perimeter of said removable portion.

29. The method of claim 28 wherein said initiation area extends at least 5 millimeters from said perimeter.

30. The method of claim 25 wherein said releasable adherence applied to said remaining area further comprises a third peel force that is different from said second peel force.

31. The method of claim 25 wherein said releasable adherence having a third peel force is applied to a non-removable portion, wherein said third peel force is greater than said first peel force.

32. The method of claim 25 wherein said removable portion comprises a tacky surface upon removal from said container.

33. The method of claim 25 wherein said container comprises a tacky surface upon removal of said removable portion.

34. The method of claim 25 wherein said removable portion comprises a collectible piece.

35. The method of claim 25 wherein said removable portion comprises a portion of a larger illustration.

36. The method of claim 25 wherein further comprising the step of applying a unique code to said first film layer prior to said affixing at step a).

37. A container having a removable piece made by the method of claim 25.

38. A flexible container and incorporated promotional piece comprising:

a container wall structure having at least two thin film layers, wherein a first thin film layer is affixed to a second thin film layer by a releasable adherence having a first peel force at an initiation area less than a second peel force at a remaining area, and wherein said first thin film layer is releasable at any cross-section of the wall structure; and at least one removable portion of said first thin film layer wherein said removable portion possesses a size and shape defined by at least one continuous cut, wherein said initiation area adjacent said continuous cut facilitates removal of said removable portion, and wherein removal of said removable portion does not compromise the barrier properties of the container, and wherein said releasable adherence further comprises a first release agent and a second release agent, wherein said first release agent is applied to said initiation area and said second release agent is applied to said remaining area.

39. The container of claim 38 wherein said initiation area is located about a perimeter of said removable portion.

40. The container of claim 39 wherein said initiation area extends at least about 5 millimeters from said perimeter.

41. The container of claim 38 wherein said initiation area is located about a portion of a perimeter of said removable portion.

42. The container of claim 41 wherein said initiation area extends at least about 5 millimeters from said perimeter.

43. The container of claim 38 wherein said remaining area further comprises a third peel force that is different from said second peel force.

44. The container of claim 38 having a non-removable portion having a third peel force, wherein said third peel force is greater than said first peel force.

45. The container of claim 38 wherein said removable portion comprises a tacky surface.

46. The container of claim 38 wherein said container comprises a tacky surface upon removal of said removable portion.

47. The container of claim 38 wherein said removable portion comprises a collectible piece.

48. The container of claim 38 wherein said removable portion comprises a portion of a larger illustration.

49. The container of claim 38 wherein said removable portion comprises a unique message.

50. A container having oxygen and moisture vapor barrier properties constructed of multi-layer flexible thin films and an easily removable incorporated promotional piece comprising:

a container wall structure comprising a first film layer and a second film layer, said second film layer affixed to said first film layer by a releasable adherence wherein a removable portion area between said first film layer and said second film layer comprises an initiation area having a first peel force and a remaining area having a second peel force, said second peel force being greater than said first peel force and, wherein said first thin film layer comprises at least one continuous cut, and wherein said first thin film layer is releasable at any cross-section of the container wall; and wherein said first film comprises at least one removable portion comprising said promotional piece, wherein said removable portion possesses a size and shape defined by the continuous cut, wherein at least a portion of said continuous cut is adjacent said initiation area and said first peel force facilitates initial removal of said removable portion, and wherein removal of said removable portion does not compromise the barrier properties of the container, and wherein said releasable adherence further comprises a first release agent and a second release agent, wherein said first release agent is applied to said initiation area and said second release agent is applied to said remaining area.

51. The container of claim 50 wherein said initiation area is located about a perimeter of said removable portion.

52. The container of claim 51 wherein said initiation area extends at least 5 millimeters from said perimeter.

53. The container of claim 50 wherein said initiation area is located about a portion of a perimeter of said removable portion.

54. The container of claim 53 wherein said initiation area extends at least 5 millimeters from said perimeter.

55. The container of claim 50 wherein said remaining area further comprises a third peel force that is different from said second peel force.

56. The container of claim 50 having a non-removable portion having a third peel force, wherein said third peel force is greater than said first peel force.

57. The container of claim 50 wherein said removable portion comprises a tacky surface.

58. The container of claim 50 wherein said container comprises a tacky surface upon removal of said removable portion.

59. The container of claim 50 wherein said removable portion comprises a collectible piece.

60. The container of claim 50 wherein said removable portion comprises a portion of a larger illustration.

61. The container of claim 50 wherein said removable portion comprises a unique code.

62. A method of incorporating a removable piece into a container constructed from multi-layer flexible thin films comprising the steps of:

a) affixing a first film layer to a second film layer by a releasable adherence having a first peel force at an initiation area and a second peel force at a remaining area, wherein said first thin film layer is releasable at any cross-section;

b) scoring, thereby defining, a removable portion of said first film layer; and c) forming a container with a wall structure having at least said first film layer and said second film layer, and d) wherein said releasable adherence further comprises a first release agent and a second release agent, wherein said first release agent is applied to said initiation area and said second release agent is applied to said remaining area.

63. The method of claim 62 wherein said initiation area is located about a perimeter of said removable portion.

64. The method of claim 63 wherein said initiation area extends at least 5 millimeters from said perimeter.

65. The method of claim 62 wherein said initiation area is located about a portion of a perimeter of said removable portion.

66. The method of claim 65 wherein said initiation area extends at least 5 millimeters from said perimeter.

67. The method of claim 62 wherein said releasable adherence applied to said remaining area further comprises a third peel force that is different from said second peel force.

68. The method of claim 62 wherein said releasable adherence having a third peel force is applied to a non-removable portion, wherein said third peel force is greater than said first peel force.

69. The method of claim 62 wherein said removable portion comprises a tacky surface upon removal from said container.

70. The method of claim 62 wherein said container comprises a tacky surface upon removal of said removable portion.

71. The method of claim 62 wherein said removable portion comprises a collectible piece.

72. The method of claim 62 wherein said removable portion comprises a portion of a larger illustration.

73. The method of claim 62 wherein further comprising the step of applying a unique code to said first film layer prior to said affixing at step a).

74. A container having a removable piece made by the method of claim 62.

* * * * *